US009976427B2

(12) United States Patent
Winn et al.

(10) Patent No.: US 9,976,427 B2
(45) Date of Patent: May 22, 2018

(54) INSTALLATION FAULT TOLERANT DAMPER

(71) Applicant: United Technologies Corporation, Hartford, CT (US)

(72) Inventors: Joshua Daniel Winn, Ellington, CT (US); David A. Niezelski, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 325 days.

(21) Appl. No.: 14/721,847

(22) Filed: May 26, 2015

(65) Prior Publication Data

US 2016/0348514 A1 Dec. 1, 2016

(51) Int. Cl.

| | |
|---|---|
| ***F01D 5/28*** | (2006.01) |
| ***F01D 5/22*** | (2006.01) |
| ***F01D 5/14*** | (2006.01) |
| ***F01D 11/00*** | (2006.01) |

(52) U.S. Cl.

CPC ..... *F01D 5/28* (2013.01); *F01D 5/147* (2013.01); *F01D 5/22* (2013.01); *F01D 11/006* (2013.01); *F05D 2300/17* (2013.01)

(58) Field of Classification Search

CPC ..... F01D 5/147; F01D 5/22; F01D 11/006; F01D 5/045; F01D 5/10; F01D 5/16; F01D 25/04; F01D 25/06; F01D 5/28; F05D 2300/17

See application file for complete search history.

(56) References Cited

U.S. PATENT DOCUMENTS

| | | | | |
|---|---|---|---|---|
| 5,513,955 | A | 5/1996 | Barcza | |
| 2005/0079062 | A1 * | 4/2005 | Surace | F01D 5/22 416/248 |
| 2014/0112786 | A1 | 4/2014 | Donnell et al. | |

FOREIGN PATENT DOCUMENTS

| | | | | |
|---|---|---|---|---|
| EP | 0816638 | 1/1998 | | |
| WO | WO 2014051688 A1 * | 4/2014 | | F01F 5/26 |
| WO | 2015026416 | 2/2015 | | |

OTHER PUBLICATIONS

Extended European Search Report dated 101042016 in European Application No. 16171273.2.

* cited by examiner

*Primary Examiner* — Dwayne J White
*Assistant Examiner* — Justin A Pruitt
(74) *Attorney, Agent, or Firm* — Snell & Wilmer L.L.P.

(57) ABSTRACT

The present disclosure provides systems for preventing improper installation of a damper seal. In various embodiments, an airfoil assembly may comprise a platform, an airfoil extending from the platform, and a platform tab. The airfoil may comprise a gaspath face and a non-gaspath face. The non-gaspath face may at least partially define a cavity. The airfoil may comprise a pressure side and a suction side. The platform tab may be located adjacent to the suction side of the airfoil. The platform tab may extend from the platform in the opposite direction as the airfoil and may be configured to prevent a damper seal tab from being inserted radially inwards of the platform tab.

18 Claims, 5 Drawing Sheets

INSTALLATION FAULT TOLERANT DAMPER

FIELD

This disclosure relates to a gas turbine engine, and more particularly to a turbine blade design to prevent improper installation of a damper seal.

BACKGROUND

Gas turbine engines generally include a compressor to pressurize inflowing air, a combustor to burn a fuel in the presence of the pressurized air, and a turbine to extract energy from the resulting combustion gases. The turbine may include multiple rotatable turbine blade arrays separated by multiple stationary vane arrays. The turbine blades are coupled to a rotor disk assembly which is configured to rotate about an engine axis. Typically, a damper seal is located on the radially inward side of a high pressure turbine blade. If the damper seal is incorrectly installed in the reverse position, the damper seal may bend and lose its ability to efficiently seal.

SUMMARY

The present disclosure provides systems for preventing improper installation of a damper seal. In various embodiments, an airfoil assembly is described herein. The airfoil assembly may comprise a platform, an airfoil extending from the platform, and a platform tab. The airfoil may comprise a gaspath face and a non-gaspath face. The non-gaspath face may at least partially define a cavity. The airfoil may comprise a pressure side and a suction side. The platform tab may be located adjacent to the suction side of the airfoil. The platform tab may extend from the platform in the opposite direction as the airfoil and may be configured prevent a damper seal tab from being inserted radially inwards of the platform tab.

In various embodiments, a gas turbine engine is described herein. The gas turbine engine may comprise a compressor section, a combustor section, and a turbine section. The turbine section may include a plurality of airfoils, wherein each airfoil projects from a platform. The platform may comprise an airfoil extending from the platform, and a platform tab. The airfoil may comprise a gaspath face and a non-gaspath face. The non-gaspath face may at least partially define a cavity. The airfoil may comprise a pressure side and a suction side. The platform tab may be located adjacent to the suction side of the airfoil. The platform tab may extend from the platform in the opposite direction as the airfoil and may be configured to interfere with a damper seal tab in response to a damper seal being incorrectly installed.

In various embodiments, an apparatus is described herein. The apparatus may comprise a platform, an airfoil extending from the platform, and a platform tab. The airfoil may comprise a gaspath face and a non-gaspath face. The non-gaspath face may at least partially define a cavity. The airfoil may comprise a pressure side and a suction side. The platform tab may be located adjacent to the suction side of the airfoil. The platform tab may extend from the platform in the opposite direction as the airfoil and may be configured to prevent a damper seal tab from being inserted radially inwards of the platform tab.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical changes and adaptations in design and construction may be made in accordance with this invention and the teachings herein. Thus, the detailed description herein is presented for purposes of illustration only and not of limitation. The scope of the invention is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials. In some cases, reference coordinates may be specific to each figure.

As used herein, "aft" refers to the direction associated with the tail (e.g., the back end) of an aircraft, or generally, to the direction of exhaust of the gas turbine. As used herein, "forward" refers to the direction associated with the nose (e.g., the front end) of an aircraft, or generally, to the direction of flight or motion.

Figure 1:
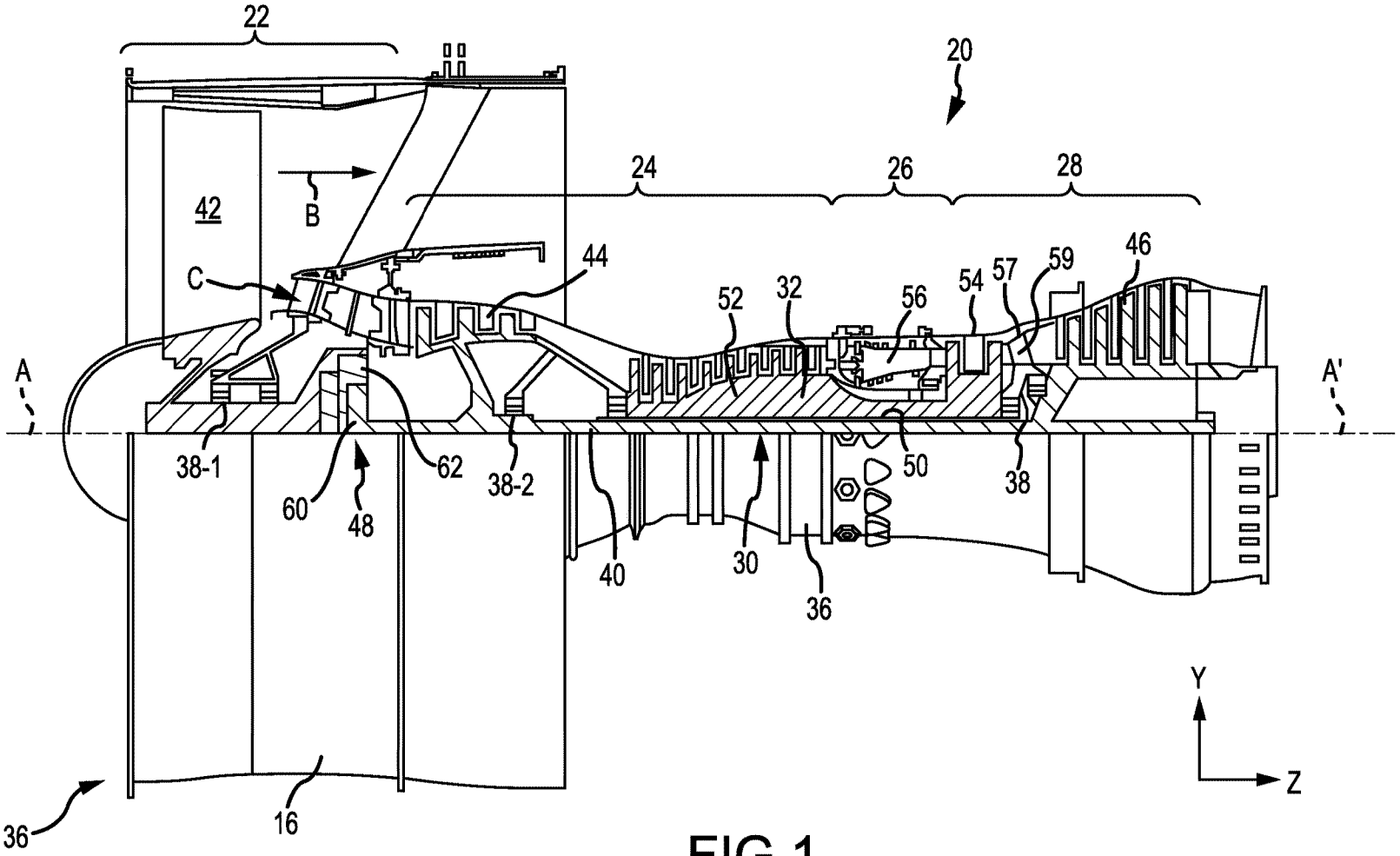
FIG. 1 illustrates an example gas turbine engine, in accordance with various embodiments.

In various embodiments and with reference to FIG. 1, a gas turbine engine 20 is provided. Gas turbine engine 20 may be a two-spool turbofan that generally incorporates a fan section 22, a compressor section 24, a combustor section 26 and a turbine section 28. Alternative engines may include, for example, an augmentor section among other systems or features. In operation, fan section 22 can drive air along a bypass flow-path B while compressor section 24 can drive air along a core flow-path C for compression and communication into combustor section 26 then expansion through turbine section 28. Although depicted as a turbofan gas turbine engine 20 herein, it should be understood that the concepts described herein are not limited to use with turbofans as the teachings may be applied to other types of gas turbine engines including three-spool architectures.

Figure 2:
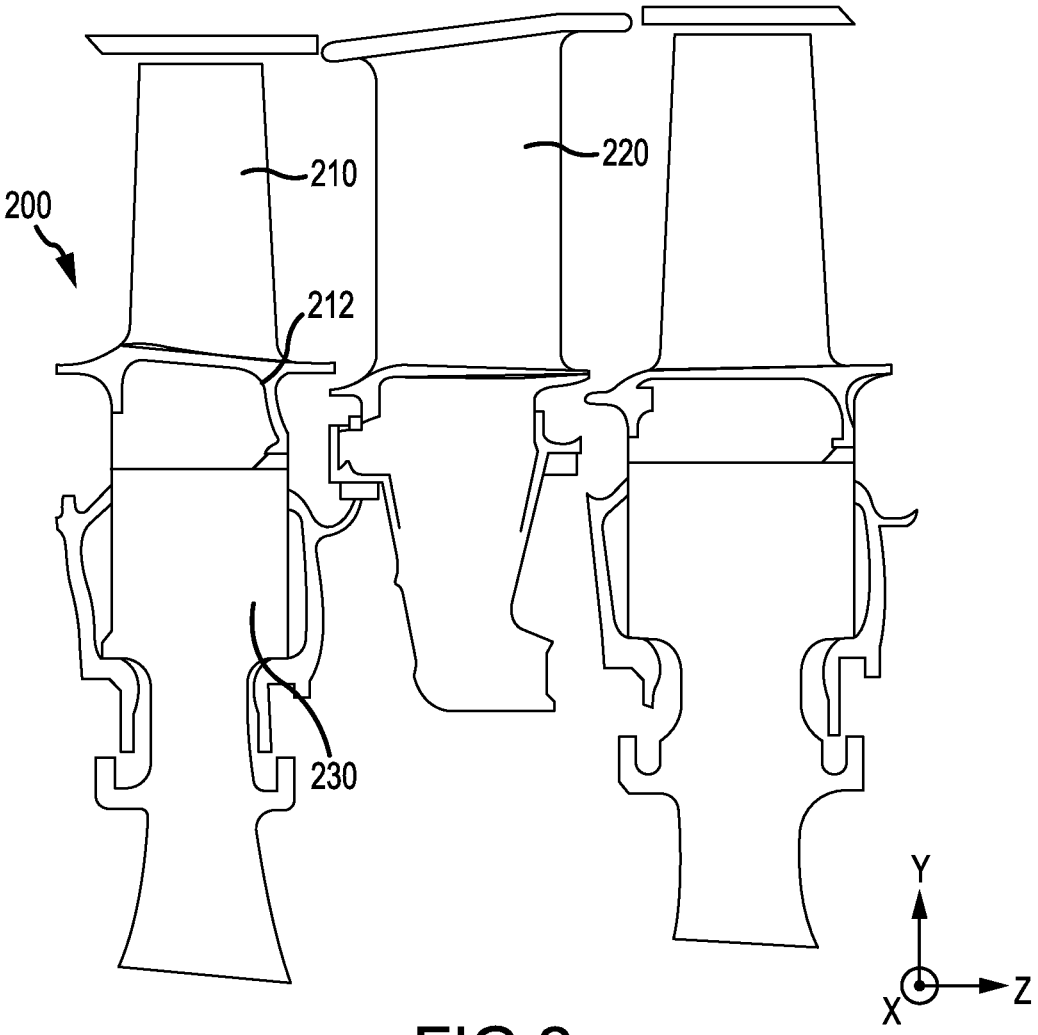
FIG. 2 illustrates a cross-section view of a high pressure turbine section of a gas turbine engine, in accordance with various embodiments.

Gas turbine engine 20 may generally comprise a low speed spool 30 and a high speed spool 32 mounted for rotation about an engine central longitudinal axis A-A' relative to an engine static structure 36 via one or more bearing systems 38 (shown as bearing system 38-1 and bearing system 38-2 in FIG. 2). It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low pressure (or first) compressor section 44 (also referred to a low pressure compressor) and a low pressure (or first) turbine section 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high pressure compressor 52 (e.g., a second compressor section) and high pressure (or second) turbine section ("HPT") 54. A combustor 56 may be located between high pressure compressor 52 and HPT 54. A mid-turbine frame 57 of engine static structure 36 may be located generally between HPT 54 and low pressure turbine 46. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow may be compressed by low pressure compressor 44 then high pressure compressor 52, mixed and burned with fuel in combustor 56, then expanded over HPT 54 and low pressure turbine 46. Mid-turbine frame 57 includes airfoils 59 which are in the core airflow path. Low pressure turbine 46 and HPT 54 rotationally drive the respective low speed spool 30 and high speed spool 32 in response to the expansion.

Gas turbine engine 20 may be, for example, a high-bypass geared aircraft engine. In various embodiments, the bypass ratio of gas turbine engine 20 may be greater than about six (6). In various embodiments, the bypass ratio of gas turbine engine 20 may be greater than ten (10). In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about 5. In various embodiments, the bypass ratio of gas turbine engine 20 is greater than about ten (10:1). In various embodiments, the diameter of fan 42 may be significantly larger than that of the low pressure compressor 44, and the low pressure turbine 46 may have a pressure ratio that is greater than about (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other gas turbine engines including direct drive turbofans.

Typically, a damper seal is located on the radially inward side of a high pressure turbine blade. If the damper seal is installed improperly, the damper seal may bend and lose its ability to efficiently or effectively seal. Although described herein with respect to a second stage turbine blade, the disclosure as described herein may also apply to a stator or rotor of a compressor section as well as any stage turbine blade of a turbine section.

With reference now to FIGS. 1 and 2, high pressure turbine section 54 may include a plurality of airfoils including a plurality of vanes, such as vane 220, and a plurality of blades, such as blade 210. The plurality of vanes and blades may be arranged circumferentially about an engine axis A-A' to define a flow path boundary for a core flow path C. Turbine blade assembly 200 may comprise blade 210, blade platform 212, and rotor disk 230. Vane 220 and/or blade 210 may receive compressed air from compressor section 24 and/or other components of gas turbine engine 20. Blade 210 may be attached to blade platform 212. Blade 210 may be coupled to rotor disk 230 via blade platform 212. Rotor disk 230 may comprise a high pressure turbine (HPT) rotor disk. Turbine blade assembly 200 may experience extremely high temperatures from exhaust air in flow path C. Accordingly, cooling air from various engine components may help decrease operating temperatures of turbine blade assembly 200

Figure 3A:
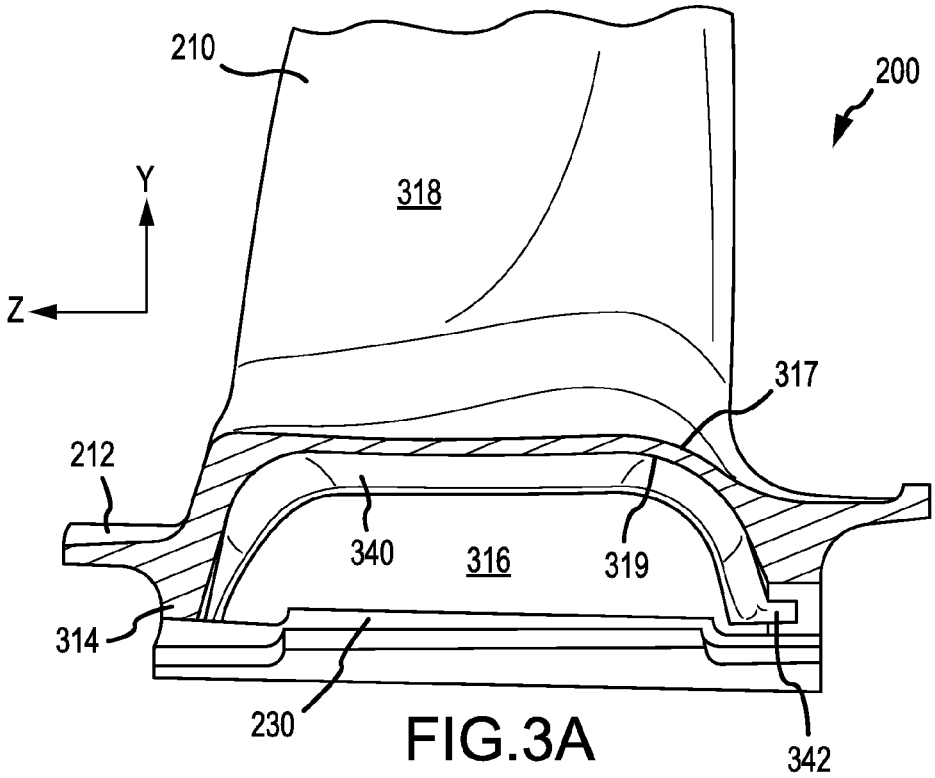
FIG. 3A illustrates a side view of a high pressure turbine blade assembly, in accordance with various embodiments.
Figure 3B:
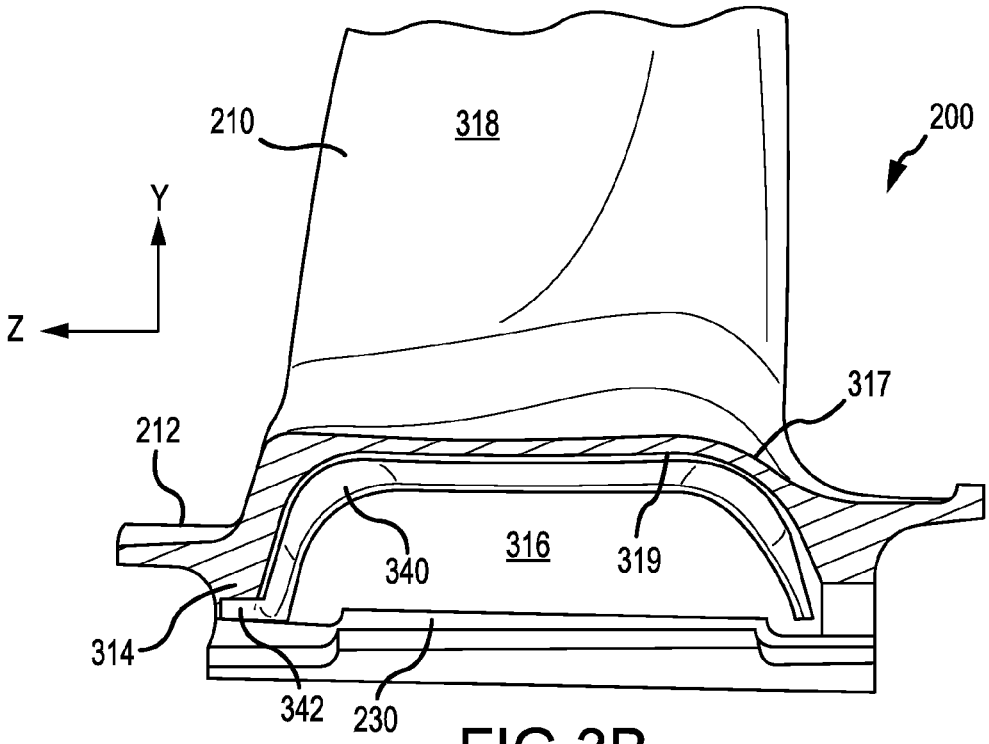
FIG. 3B illustrates a side view of a high pressure turbine blade assembly with an incorrectly installed damper seal, in accordance with various embodiments.

With respect to FIGS. 3A-3B, elements with like element numbering as depicted in FIG. 2, are intended to be the same and will not be repeated for the sake of clarity.

Figure 4:
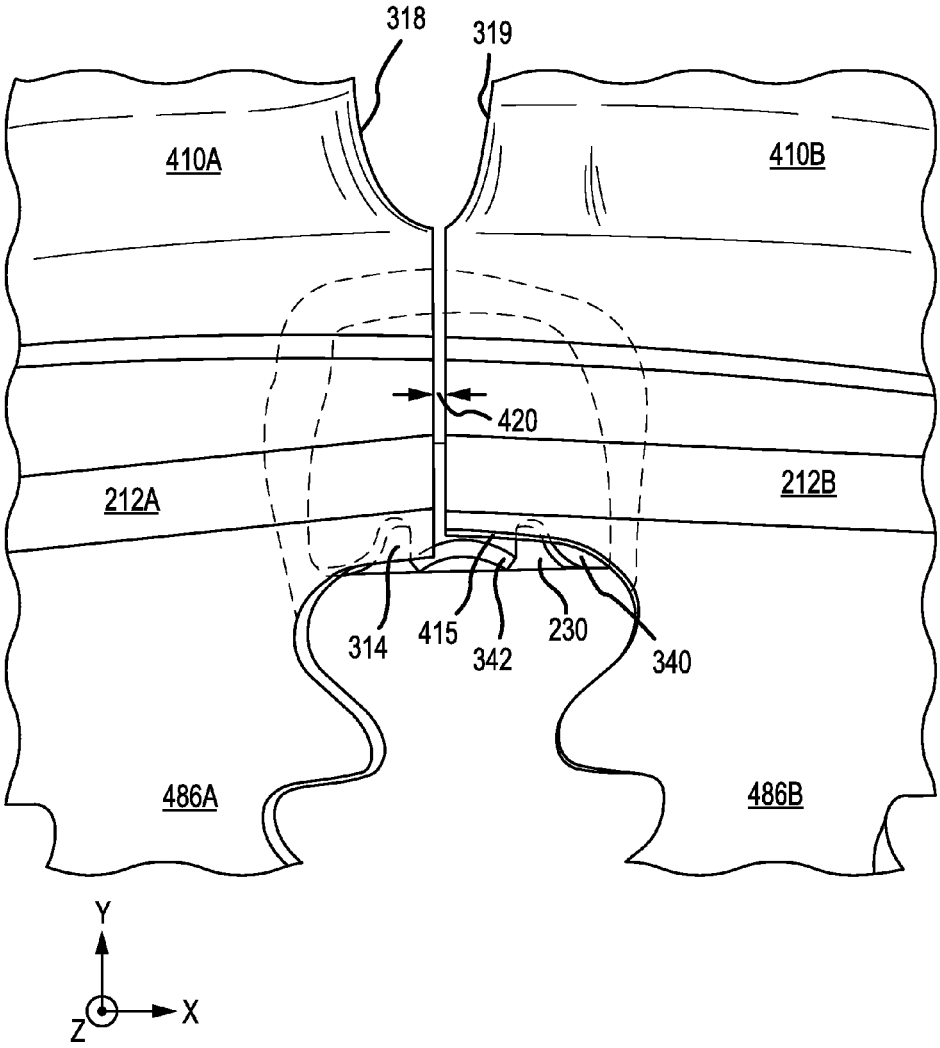
FIG. 4 illustrates an aft view of a high pressure turbine blade assembly with an incorrectly installed damper seal, in accordance with various embodiments.

With reference now to FIGS. 1 and 3A, blade 210 may at least partially define an inner cavity 316. Damper seal 340 may be located within cavity 316. Damper seal 340 may seat against the radially outward face of cavity 316. Damper seal 340 may be configured to seal at least a portion of cavity 316. Damper seal 340 may be configured to dampen air flow within cavity 316. Damper seal 340 may include a damper seal tab 342. Cavity 316 may receive air from compressor section 24 and/or other components of gas turbine engine 20. The air received by inner cavity 316 may have a lower temperature than ambient air within high pressure turbine section 54. Accordingly, this received air can be used to cool blade 210 and/or damper seal 340. Furthermore, cavity 316 may be further defined by an adjacent blade as illustrated in FIG. 4. In this regard, the received air may be used to cool an adjacent blade.

In various embodiments, blade 210 may comprise an austenitic nickel-chromium-based alloy such as Inconel®, which is available from Special Metals Corporation of New Hartford, N.Y., USA. In various embodiments, damper seal 340 may comprise a cobalt-based alloy.

Blade platform 212 may be configured to attach to rotor disk 230. As previously mentioned, blade platform 212 may partially define a flow path boundary for a core flow path C. In this regard, the radially outward surface 317 of blade platform 212 may be referred to as a gaspath face. Similarly, the radially inward face 319 of blade platform 212 may be referred to as a non-gaspath face. In various embodiments, blade 210 may be a second stage turbine blade. With reference now to FIGS. 3A and 4, blade 210, 410A, and 410B may comprise a pressure side 319 and a suction side 318. Suction side 318 may be located on the opposite side of blade 210 as the pressure side 319. Accordingly, FIG. 3A is a view of the suction side of blade 210.

In various embodiments and with reference now to FIG. 3A, platform tab 314 may extend radially inward from blade platform 212. In various embodiments, platform tab 314 may be integral to blade platform 212. Platform tab 314 may extend towards rotor disk 230. In various embodiments, platform tab 314 may be configured to close the gap between rotor disk 230 and blade platform 212. In various embodiments, platform tab 314 may be configured to minimize the gap between rotor disk 230 and blade platform 212. Platform tab 314 may prevent damper seal 340 from being installed in a reverse orientation. Platform tab 314 may prevent damper seal tab 342 from being inserted radially inward of platform tab 314. In various embodiments, platform tab 314 may be located on the aft side of blade platform 212. In various embodiments, platform tab 314 may be located adjacent to the suction side 318 of blade 210.

With reference now to FIG. 3B, damper seal 340 is illustrated in an incorrectly installed position. During installation, platform tab 314 may interfere with damper seal tab 342, preventing damper seal 340 from being placed into a proper position. As a result, platform tab 314 prevents damper seal 340 from being incorrectly installed in this manner. Accordingly, with the addition of platform tab 314, damper seal 340 may not be able to be installed in the position as shown in FIG. 3B.

With respect to FIG. 4, elements with like element numbering as depicted in FIGS. 2-3B, are intended to be the same and will not be repeated for the sake of clarity.

With reference now to FIGS. 3A and 4, blade 410A and 410B may be similar to blade 210 of FIGS. 2-3B. Blade 410A and 410B are illustrated in an installed position. Damper seal 340 may be configured to seal gap 420 between blade 410A and 410B when in the installed position. When in the installed position, platform tab 314 of blade 410A may extend further radially inward than pressure side portion 415 of blade 410B. In this regard, platform tab 314 of blade 410A may prevent damper seal 340 from being incorrectly installed, as previously described, while pressure side portion 415 of blade 410B may be configured to leave a gap between blade 410B and rotor disk 230 whereby air may enter and/or exit cavity 316. Accordingly, blade 410A and blade 410B may be configured such that when blade 410A and blade 410B are in an installed position, blade 410A prevents damper seal 340 from being installed in a reverse position and blade 410B allows air to flow into or out of cavity 316.

In various embodiments, blade platform 212A and blade platform 212B may be similar to blade platform 212 of FIGS. 2-3B. In various embodiments, blade platform 212A may include attachment portion 486A. Attachment portion 486A may be integral to blade platform 212A. Attachment portion 486A may be complementary to rotor disk 230. In various embodiments, blade platform 212B may include attachment portion 486B. Attachment portion 486B may be similar to attachment portion 486A.

Figure 5:
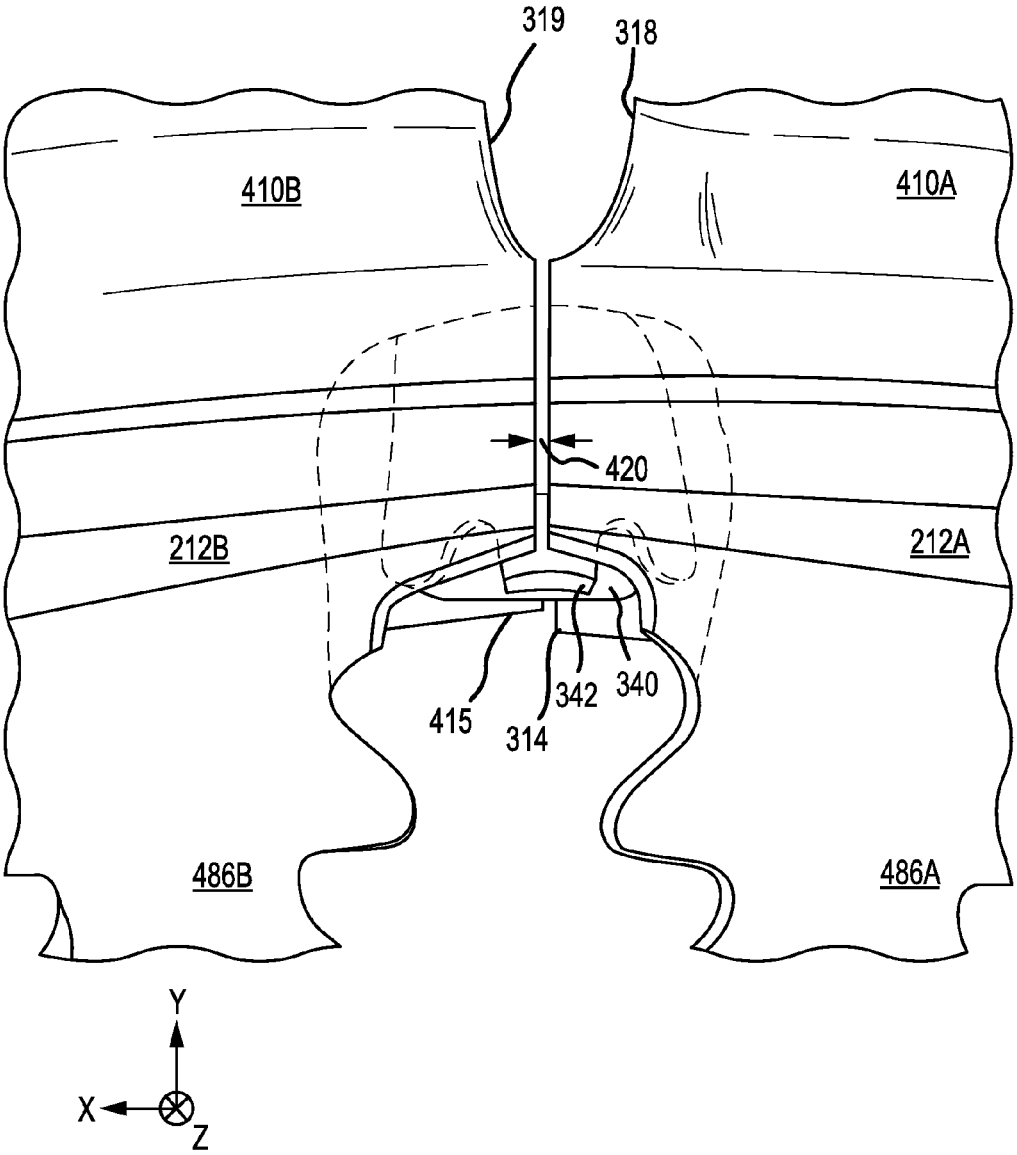
FIG. 5 illustrates a front view of a high pressure turbine blade assembly with a correctly installed damper seal, in accordance with various embodiments.

With reference to FIG. 5, a front view of a high pressure turbine blade assembly with a correctly installed damper seal is illustrated, in accordance with various embodiments. With reference to the axial direction (z-direction), damper seal tab 342 and platform tab 314 may be located on the opposite sides of damper seal 340 when in a correctly installed position, in accordance with various embodiments.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An airfoil assembly comprising:

a platform comprising:

a gaspath face; and a non-gaspath face, wherein the non-gaspath face at least partially defines a cavity;

an airfoil extending from the platform, wherein the airfoil comprises a pressure side and a suction side; and a platform tab located adjacent to the suction side of the airfoil, wherein the platform tab extends from the platform in an opposite direction as the airfoil to minimize a first gap between the platform tab and a rotor disk such that a maximum thickness of the first gap is less than a thickness of a damper seal tab, and the platform tab is configured to mechanically resist the damper seal tab from being inserted radially inwards of the platform tab.

2. The airfoil assembly of claim 1, wherein the airfoil assembly is a second stage turbine blade.

3. The airfoil assembly of claim 1, wherein the damper seal is configured to seal a portion of the cavity.

4. The airfoil assembly of claim 1, wherein the damper seal is configured to seal a gap between the airfoil and an adjacent airfoil.

5. The airfoil assembly of claim 1, wherein the damper seal is configured to dampen air flow within the cavity.

6. The airfoil assembly of claim 1, wherein the platform is configured to attach to a rotor disk.

7. The airfoil assembly of claim 6, wherein the platform tab is configured to prevent a damper seal tab from being inserted between the platform and the rotor disk when in an installed position.

8. The airfoil assembly of claim 1, wherein the airfoil comprises an austenitic nickel-chromium-base superalloy.

9. The airfoil assembly of claim 1, wherein the damper seal comprises a cobalt-based alloy.

10. A gas turbine engine comprising:

a compressor section;

a combustor section; and a turbine section including:

a first platform having a first airfoil extending therefrom, the first platform comprising a first gaspath face and a first non-gaspath face, the first non-gaspath face at least partially defining a first cavity, and the first airfoil comprising a pressure side and a suction side;

a second platform having a second airfoil extending thereform, the second platform comprising a second gaspath face and a second non-gaspath face, the second non-gaspath face at least partially defining a second cavity;

a first platform tab located adjacent to the suction side of the first airfoil and extending from the first platform in an opposite direction as the first airfoil to minimize a first gap between the first platform tab and a rotor disk such that a maximum thickness of the first gap is less than a thickness of a damper seal tab; and a second platform tab extending from the second platform in an opposite direction as the second airfoil, wherein the second platform tab is circumferentially adjacent to the first platform tab, wherein the first platform tab extends further radially inward than the second platform tab and is configured to interfere with the damper seal tab in response to a damper seal being incorrectly installed.

11. The gas turbine engine of claim 10, wherein the airfoil is a second stage turbine blade.

12. The gas turbine engine of claim 10, wherein the damper seal is configured to seal at least a portion of the cavity, including a gap between the airfoil and an adjacent airfoil.

13. The gas turbine engine of claim 10, wherein the damper seal is configured to dampen air flow within the cavity.

14. The gas turbine engine of claim 10, wherein the platform is configured to attach to a rotor disk.

15. The gas turbine engine of claim 14, wherein the first platform tab is configured to prevent a damper seal tab from being inserted between the first platform and the rotor disk when in an installed position.

16. The gas turbine engine of claim 10, wherein the airfoil comprises an austenitic nickel-chromium-base superalloy.

17. The gas turbine engine of claim 10, wherein the damper seal comprises a cobalt-base alloy.

18. An apparatus, comprising:

a platform comprising:

a gaspath face; and a non-gaspath face, wherein the non-gaspath face at least partially defines a cavity;

an airfoil extending from the platform, wherein the airfoil comprises a pressure side and a suction side; and a platform tab located adjacent to the suction side of the airfoil, wherein the platform tab extends from the platform in an opposite direction as the airfoil to minimize a first gap between the platform tab and a rotor disk such that a maximum thickness of the first gap is less than a thickness of a damper seal tab, and is configured to mechanically resist the damper seal tab from being inserted radially inwards of the platform tab.

* * * * *